US008823625B2

(12) United States Patent
Guo et al.

(10) Patent No.: US 8,823,625 B2
(45) Date of Patent: Sep. 2, 2014

(54) LCD DEVICE CAPABLE OF CHANGING THE SCAN ORDER AND DRIVING METHOD THEREOF

(75) Inventors: Dongsheng Guo, Guangdong (CN); Liangchan Liao, Guangdong (CN)

(73) Assignee: Shenzhen China Star Optoelectronics Technology Co. Ltd., Shenzhen (CN)

( * ) Notice: Subject to any disclaimer, the term of this patent is extended or adjusted under 35 U.S.C. 154(b) by 727 days.

(21) Appl. No.: 12/997,006

(22) PCT Filed: Nov. 24, 2010

(86) PCT No.: PCT/CN2010/079035

§ 371 (c)(1), (2), (4) Date: Dec. 9, 2010

(87) PCT Pub. No.: WO2012/051768

PCT Pub. Date: Apr. 26, 2012

(65) Prior Publication Data

US 2012/0092307 A1 Apr. 19, 2012

(30) Foreign Application Priority Data

Oct. 18, 2010 (CN) ..... 2010 1 0518748

(51) Int. Cl.
*G09G 3/36* (2006.01)

(52) U.S. Cl.
CPC ..... *G09G 3/3666* (2013.01); *G09G 3/3614* (2013.01); *G09G 2330/021* (2013.01); *G09G 2310/0213* (2013.01)
USPC ..... 345/98

(58) Field of Classification Search
CPC ..... G09G 3/36
USPC ..... 345/87, 90, 103, 204, 92, 98; 349/73, 349/143
See application file for complete search history.

(56) References Cited

U.S. PATENT DOCUMENTS

| | | | | |
|---|---|---|---|---|
| 5,151,689 | A * | 9/1992 | Kabuto et al. | 345/103 |
| 5,585,815 | A * | 12/1996 | Nakashima et al. | 345/100 |
| 5,633,653 | A * | 5/1997 | Atherton | 345/98 |
| 8,179,350 | B2 * | 5/2012 | Park et al. | 345/92 |
| 2008/0291186 | A1 * | 11/2008 | Chu et al. | 345/205 |
| 2009/0033590 | A1 * | 2/2009 | Feng | 345/58 |
| 2011/0285950 | A1 * | 11/2011 | Su et al. | 349/139 |

FOREIGN PATENT DOCUMENTS

| | | | |
|---|---|---|---|
| CN | 101561597 | A | 10/2009 |
| CN | 101710481 | A | 5/2010 |
| JP | 2009236937 | A | 10/2009 |
| KR | 20070073309 | A | 7/2007 |
| TW | 508555 | B | 11/2002 |

* cited by examiner

*Primary Examiner* — Pegeman Karimi
(74) *Attorney, Agent, or Firm* — Mark M. Friedman

(57) ABSTRACT

An LCD device capable of changing the scan order and a driving method thereof are disclosed. The LCD device includes a plurality of pixel units which are arranged in an array of rows, first scan lines, second scan lines, and switch units. The pixel units of each row are divided into first pixel units and second pixel units. The switch units are respectively electrically coupled to one end of each first scan line and to one end of each second scan line for controlling conduction states of the first scan lines and the second scan lines, thereby controlling an order of updating the image signals for the first pixel units and the second pixel units. Thus, the scan lines are driven in the order according to whichever total sum of differences between gray values thereof is smaller, so that the power consumption of data chips is decreased.

15 Claims, 5 Drawing Sheets

LCD DEVICE CAPABLE OF CHANGING THE SCAN ORDER AND DRIVING METHOD THEREOF

FIELD OF THE INVENTION

The present invention relates to a liquid-crystal display (LCD) device and a driving method thereof, and more particularly to an LCD device being capable of changing scan order and a driving method thereof.

BACKGROUND OF THE INVENTION

Liquid crystal displays have the advantages of low radiation and compact size; thus, the LCDs are now being widely used and becoming a mainstream display.

In the case of the characteristics of liquid crystal molecules, due to the liquid crystal molecules have polarity, if the liquid crystal molecules have been fixed in one polarity voltage, the charges in the liquid crystal molecules may be fixed for forming a dipole. While the positive and negative charges are fixed at both ends of the liquid crystal molecules, it will result in a slow response speed of the liquid crystal molecules. Thus, in order to make the liquid crystal molecules move, the liquid crystal molecules must be driven by an alternating current (AC). The driving method for driving an LCD in the AC can usually be divided into four categories: a frame inversion, a row/gate/line inversion, a column/data/source inversion and a dot inversion.

In the driving method of the dot inversion, in order to reduce costs and improve the production yield of the LCDs, a method which adopts a single data line to control pixels of two columns is currently proposed. Referring to FIG. 1, FIG. 1 is a schematic drawing illustrating a data line to control pixels of two columns on a conventional circuit of an LCD panel. The conventional circuit of an LCD panel includes a plurality of scan lines G(n), G(n+1) . . . which are disposed in horizontal, a plurality of data lines D(n), D(n+1) . . . which are disposed in vertical, and a plurality of pixel units which are arranged in an array. The pixel units of each row are electrically coupled alternative to two scan lines G(n) and G(n+1). Each data lines D(n), D(n+1) . . . are electrically coupled respectively to the pixel units 110 of two adjacent columns, and the polarities of the pixel units which are arranged in an array are distributed as the dot inversion.

The method of adopting a single data line to control the pixels of two columns is effective in reducing the costs of the data lines. However, the scan lines G(n), G(n+1) . . . are driven in turn, thereby causing each data line D (n), D (n+1) . . . having to frequently transmit image signals with two different polarities, for example, from positive to negative, from negative to positive, and so on alternately. Thus, the data chips which provide the image signals consume large amounts of power.

SUMMARY OF THE INVENTION

Accordingly, an objective of the present invention is to provide an LCD device which can control the driving orders of scan lines through switches.

Another objective of the present invention is to provide a driving method for an LCD device to drive the scan lines in a more energy-efficient scanning order, thereby decreasing the power consumption of the data chips.

To achieve the foregoing objectives, according to an aspect of the present invention, an LCD device is provided, which includes a plurality of pixel units which are arranged in an array of rows, a plurality of data lines, a plurality of first scan lines, a plurality of second scan lines and a plurality of switch units. The pixel units of each row are divided into a plurality of first pixel units and a plurality of second pixel units. Each of the data lines is electrically coupled to the first pixel unit and the second pixel unit of each row for transmitting image signals. The first scan lines and the second scan lines are disposed parallel to each other, in which the pixel units of each row are disposed between one of the first scan lines and one of the second scan lines. Furthermore, the first pixel units and the second pixel units are respectively electrically coupled to the first scan line and the second scan line. The switch units are respectively electrically coupled to one end of each of the first scan lines and one end of each of the second scan lines for controlling conduction states of the first scan lines and the second scan lines to control an order for updating the image signals for the first pixel units and the second pixel units.

Preferably, the order which to update the first pixel units or the second pixel units firstly is according to whichever total sum of differences between gray values thereof is smaller.

The LCD device further includes a first switching signal line and a second switching signal line. The first switching signal line, which is electrically coupled to each of the first scan lines via the switch units for simultaneously connecting or disconnecting the first scan lines; and the second switching signal line, which is electrically coupled to each of the second scan lines via the switch units for simultaneously connecting or disconnecting the second scan lines.

In the preferred embodiment of the present invention, the switch units are a plurality of thin film transistors. The thin film transistors (TFTs), which are electrically coupled to the first switching signal line, are electrically coupled to each other via a plurality of gate terminals of the thin film transistors; and the thin film transistors, which are electrically coupled to the second switching signal line, are electrically coupled to each other via a plurality of gate terminals of the thin film transistors. In addition, the LCD device further comprises a control unit. The control unit is electrically coupled to one end of the first switching signal line and one end of the second switching signal line so as to output a first control signal to the first switching signal line and output a second control signal to the second switching signal line. The first control signal and the second control signal are utilized to control a conduction order of the corresponding switch units so as to either update the first pixel units firstly or to update the second pixel units firstly on the pixel units of each row.

To achieve the foregoing objectives, according to another aspect of the present invention, a driving method for driving an LCD device is provided. The LCD device includes a plurality of pixel units which are arranged in an array of rows, a plurality of data lines, a plurality of first scan lines and a plurality of second scan lines. The pixel units of each row are divided into a plurality of first pixel units and a plurality of second pixel units. Each of the data lines is electrically coupled to each row of the first pixel unit and the second pixel unit. The first pixel units and the second pixel units respectively electrically coupled to the first scan line and the second scan line. The driving method includes:

(1) providing a plurality of switch units respectively electrically coupled to one end of each of the first scan lines and one end of each of the second scan lines for controlling conduction states of the first scan lines and the second scan lines;

(2) calculating a total sum of differences between a plurality of gray values which corresponds to the data lines updating the first pixel units firstly and calculating another total sum of differences between a plurality of gray values which corresponds to the data lines updating the second pixel units firstly; and (3) selecting an order to update the first pixel units and the second pixel units on the pixel units of each row according to comparing the total sum with the another total sum.

In the preferred embodiment of the present invention, when the total sum of differences between the gray values which corresponds to the data lines updating the first pixel units firstly is larger the another total sum of differences between the gray values which corresponds to the data lines updating the second pixel units firstly, the step of selecting the order further comprises a step of switching the second scan line to the first scan line for firstly conducting the second scan line and then conducting the first scan line for updating the second pixel units firstly and then updating the first pixel units secondly. Similarly, when the another total sum of differences between the gray values which corresponds to the data lines updating the second pixel units firstly is larger the total sum of differences between the gray values which correspond to the data lines updating the first pixel units firstly, the step of selecting the order further comprises a step of switching the first scan line to the second scan line for firstly conducting the first scan line and then conducting the second scan line for updating the first pixel units firstly and then updating the second pixel units secondly.

In accordance with the LCD device and the driving method of the present invention, the switch units are disposed between the scan lines and a scan chip, and the order of the data lines updating the image signals for the first pixel units and the second pixel units is able to adjust through controlling the conduction order of the switch units. In addition, the scan lines are driven in the order according to whichever total sum of differences between the gray values thereof is smaller, so that the power consumption of data chips is decreased.

It is to be understood that both the foregoing general description and the following detailed description of the present invention are exemplary and explanatory and are intended to provide further explanation of the invention as claimed:

DETAILED DESCRIPTION OF THE PREFERRED EMBODIMENTS

Figure 1:
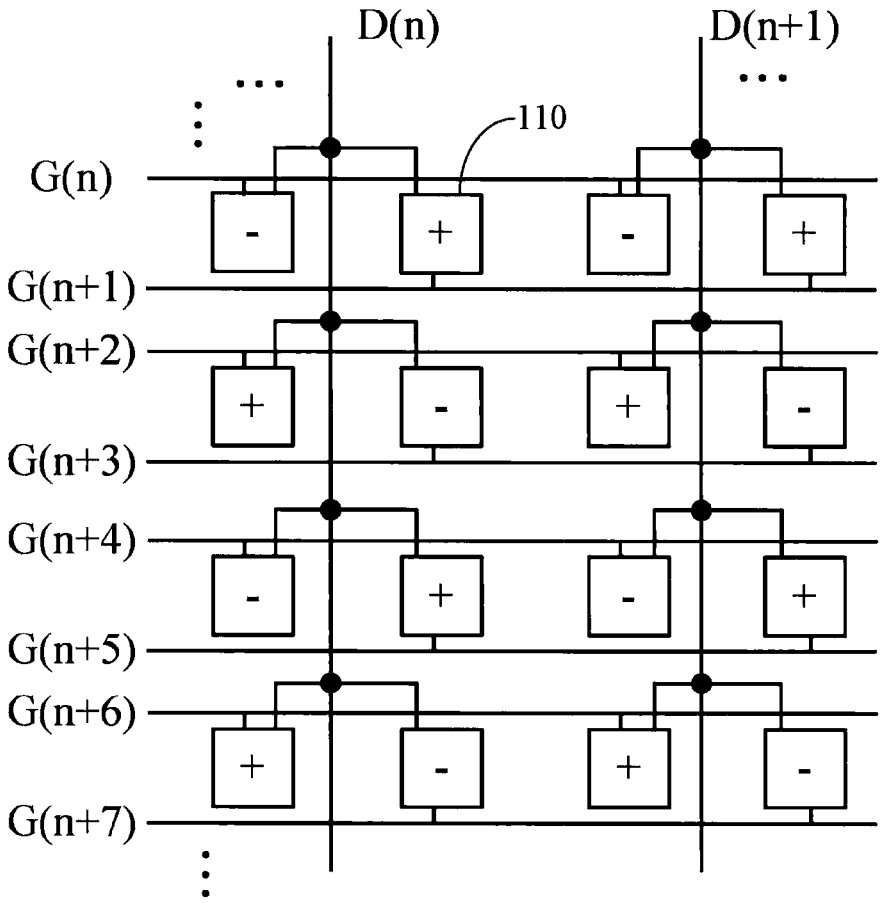
FIG. 1 (Prior Art)
FIG. 1 is a schematic drawing illustrating a data line to control pixels of two columns on a conventional circuit of an LCD panel.
Figure 2:
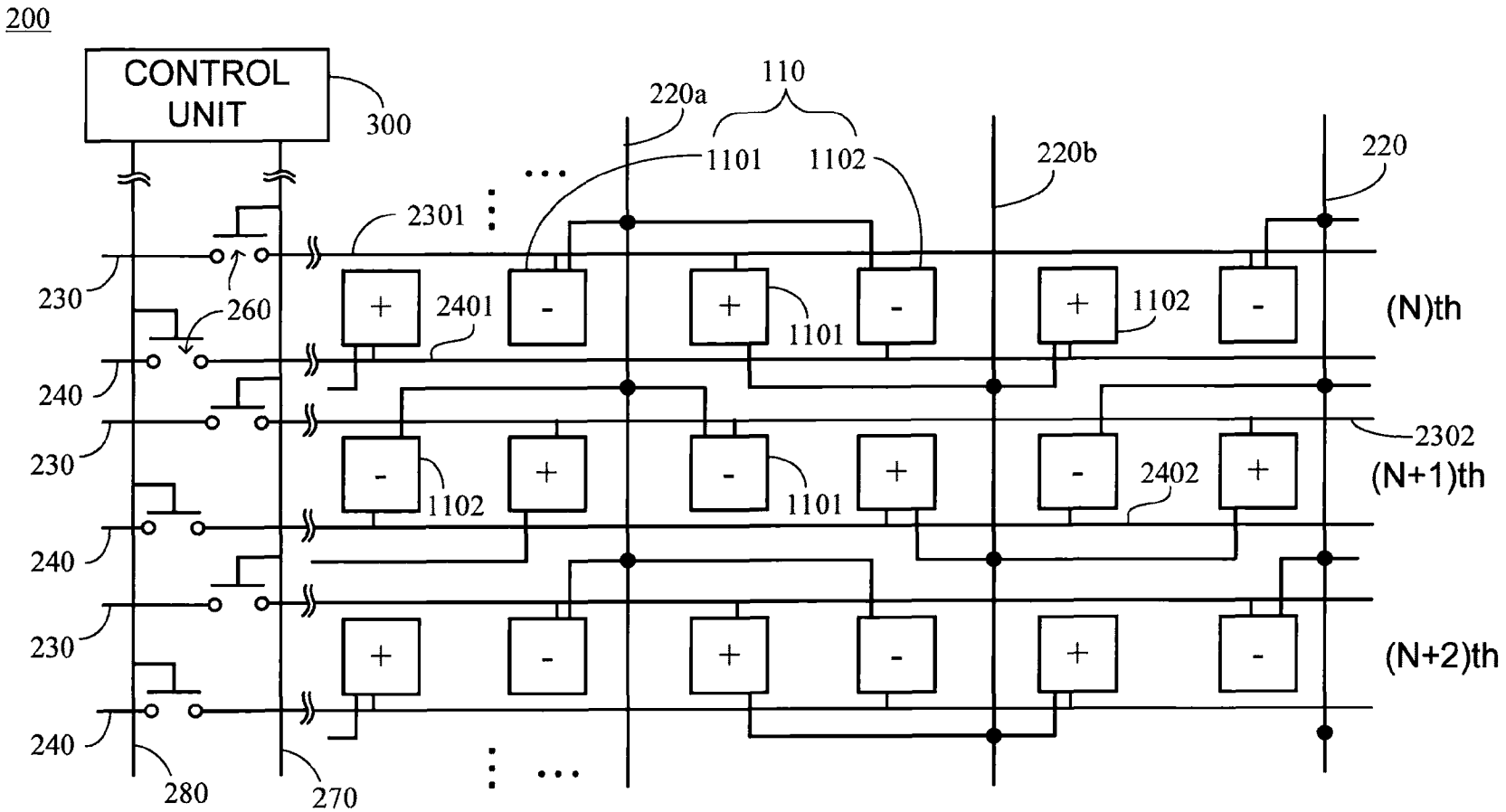
FIG. 2 is a schematic drawing illustrating an equivalent circuit of the LCD device according to one preferred embodiment of the present invention.

Referring to FIG. 2, FIG. 2 is a schematic drawing illustrating an equivalent circuit of the LCD device according to one preferred embodiment of the present invention. The LCD device 200 of the preferred embodiment includes a plurality of pixel units 110 which are arranged in an array of rows, a plurality of data lines 220, a plurality of first scan lines 230, a plurality of second scan lines 240, a plurality of switch units 260 and a control unit 300. The pixel units 110 of each row are divided into a plurality of first pixel units 1101 and a plurality of second pixel units 1102. The data lines 220 are illustrated in particular as the data lines 220*a* and 220*b*.

Each of the data lines 220 is electrically coupled to a first pixel unit 1101 and a second pixel unit 1102 of each row, and the polarity of the pixel units 110 is respectively represented as "+" and "−". The polarity of the first pixel units 1101 and the second pixel units 1102 which are connected to each of the data lines 220 is the same. There are pixel units 110 with an opposite polarity with respect to the first pixel units 1101 and the second pixel units 1102. The pixel units 110 with an opposite polarity are disposed between the first pixel units 1101 and the second pixel units 1102 which are connected to each of the data lines 220, thereby forming a distribution of the dot inversion. Each of the data lines 220 is respectively coupled to the first pixel units 1101 and the second pixel units 1102 via two thin film transistors (TFTs). The thin film transistors are not depicted on the FIG. 2 for clarity. In the pixel units 110 of an (N)th row, first pixel unit 1101 is disposed on the left of the connected data line 220, and the second pixel unit 1102 is disposed on the right of the connected data line 220. It should be noted that, in the pixel units 110 of an (N+1)th row, first pixel unit 1101 is disposed on the right of the connected data line 220, and the second pixel unit 1102 is disposed on the left of the connected data line 220. The arrangement of the pixel units 110 of an (N+2)th row is identical to that of the pixel units 110 of the (N)th row; similarly, the arrangement of the pixel units 110 of an (N+3)th row (not shown) is identical to that of the pixel units 110 of the (N+1)th row, and the rest may be deduced by analogy. One end of each of the data lines 220 is electrically coupled to a data chip (not shown) for transmitting image signals to update the pixel units 110.

The first scan lines 230 and the second scan lines 240 are disposed parallel to each other, in which the pixel units 110 of each row are disposed between one of the first scan lines 230 and one of the second scan lines 240. Furthermore, the first pixel units 1101 and the second pixel units 1102 are respectively electrically coupled to the first scan line 30 and the second scan line 240. More specifically, the gates (not shown for clarity) of the first pixel unit 1101 and the second pixel unit 1102, which are coupled to each of the data lines 220, are respectively coupled to the first scan line 230 and the second scan line 240, that is, the pixel units 110 of each row are driven by the two scan lines (i.e., the first scan line 230 and the second scan line 240).

As to the pixel units 110 of the (N)th row, when the first scan line 230 (designated as the first scan line 2301) provides a driving signal (not shown), the gates of the first pixel unit 1101 which is electrically coupled to the data line 220*a*, the first pixel unit 1101 which is electrically coupled to data line 220*b* and so on are conducted, which makes the data lines 220 update the image signals of each of said first pixel units 1101. After updating the said first pixel units 1101, when the second scan line 240 (designated as the second scan line 2401) provides a driving signal, the gates of the second pixel unit 1102 which is electrically coupled to the data line 220*a*, the second pixel unit 1102 which is electrically coupled to data line 220*b* and so on are conducted, which makes the data lines 220 update the image signals of each of said second pixel units 1102. Consequently, the pixel units 110 of the (N)th is updated completely and then to update the pixel units 110 of the (N+1)th row.

Referring to FIG. 2, the switch units 260 are respectively electrically coupled to one end of each of the first scan lines 230 and one end of each of the second scan lines 240, whereby controlling conduction states of the first scan lines and the second scan lines. Specifically, the LCD device 200 further includes a first switching signal line 270 and a second switching signal line 280. The first switching signal line 270, which is electrically coupled to each of the first scan lines 230 via the switch units 260 for simultaneously connecting or disconnecting the first scan lines 230. Similarly, the second switching signal line 280, which is electrically coupled to each of the second scan lines 240 via the switch units 260 for simultaneously connecting or disconnecting the second scan lines 240.

For instance, the switch units 260 are a plurality of thin film transistors, and the thin film transistors, which are electrically coupled to the first switching signal line 270, are electrically coupled to each other via a plurality of gate terminals (not shown) of the thin film transistors. Similarly, the thin film transistors, which are electrically coupled to the second switching signal line 280, are electrically coupled to each other via a plurality of gate terminals (not shown) of the thin film transistors.

Figure 3:
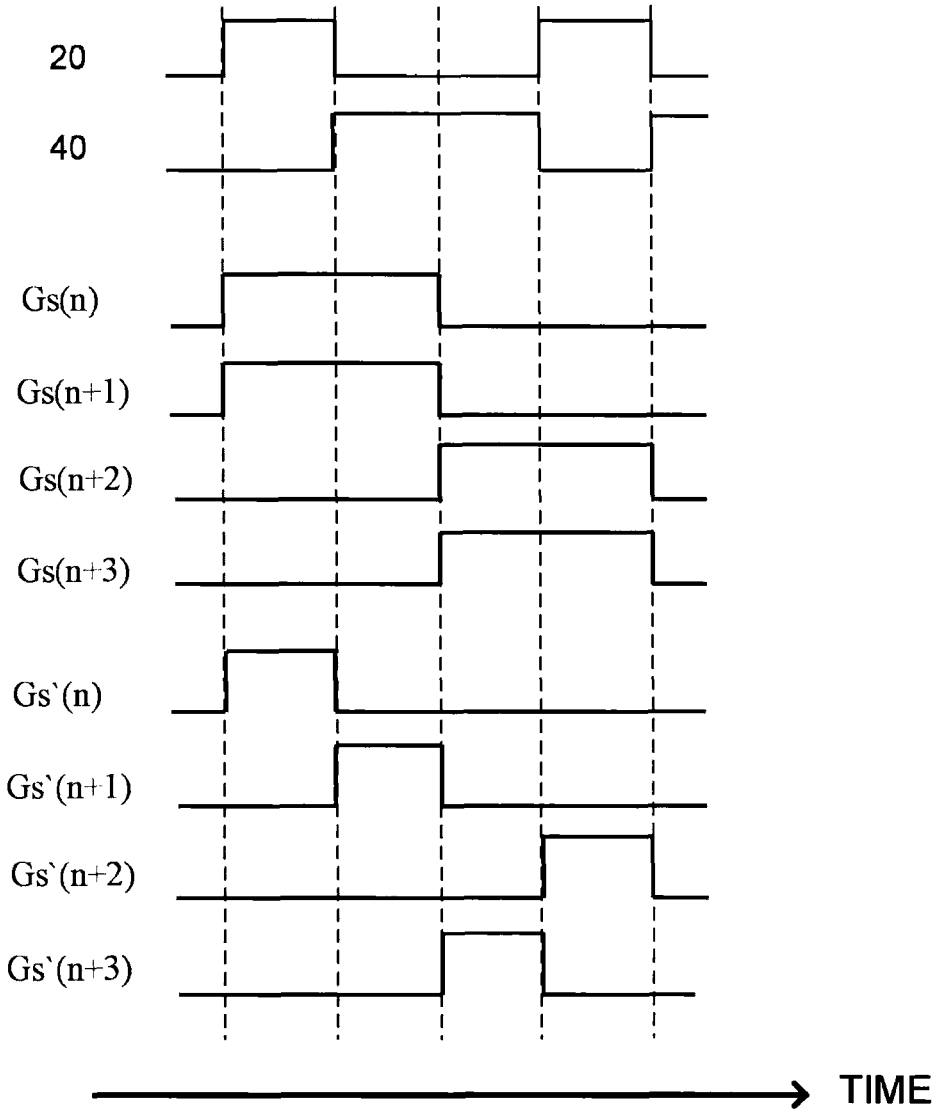
FIG. 3 is a schematic drawing illustrating the waveforms of switch signals, the corresponding scan signals, and the signals which the first and the second scan line actually receive.

Referring to FIGS. 2 and 3, FIG. 3 is a schematic drawing illustrating the waveforms of switch signals, the corresponding scan signals, and the signals which the first and the second scan line actually receive. The control unit 300 is electrically coupled to one end of the first switching signal line 270 and one end of the second switching signal line 280. The control unit 300 outputs a first control signal 20 to the first switching signal line 270 and outputs a second control signal 40 to the second switching signal line 280. The horizontal axis is time. The first control signal 20 and the second control signal 40 are utilized to control a conduction order of the corresponding switch units 260, thereby controlling the pixel units 110 of each row to update the first pixel units 1101 firstly or to update the second pixel units 1102 firstly.

Using the pixel units 110 of the (N)th and the (N+1)th rows as an example, firstly, a scan chip (not shown) provides two scan signal with identical waveforms Gs (n), Gs (n+1) to the first scan line 2301 and the second scan line 2401 at the same time, and then provides two scan signal with identical waveforms Gs (n+2), Gs (n+3) to the first scan line 2302 and the second scan line 2402 secondly. The rest may be deduced by analogy. The scan signals Gs(n), Gs(n+1), Gs(n+2) and Gs(n+3) are transmitted to the first pixel units 1101 and the second pixel units 1102 of the (N)th and the (N+1)th rows through the control of the switch units 260. Specifically, when the first control signal 20 and the second control signal 40 are at high-voltage, the switch units 260 which correspond to the first switching signal line 270 and the second switching signal line 280 switch on. Thus, the scan signals Gs(n), Gs(n+1), Gs(n+2) and Gs(n+3) are utilized to turn on the gates of the thin film transistors of the corresponding the first pixel units 1101 and the second pixel units 1102. Using FIG. 3 as an example, the scan signals Gs'(n), Gs'(n+1), Gs'(n+2) and Gs'(n+3) which the first scan line 2301, the second scan line 2401, the first scan line 2302 and the second scan line 2402 actually receive are shown. It can be seen from this that the image signals of the first pixel units 1101 are firstly updated and then those of the second pixel units 1102 are secondly updated on the pixel units 110 of the (N)th row. Then the image signals of the second pixel units 1102 are firstly updated and then those of the first pixel units 1101 are secondly updated on the pixel units 110 of the (N+1)th row.

In summary, the control unit 300 can control an order of updating the image signals for the first pixel units 1101 and the second pixel units 1102 on the pixel units 110 of each row. Therefore, the driving order of the scan lines can be controlled by using the switch units according to the LCD device of the present invention. Furthermore, the order of updating the pixel units on the left of the data lines firstly or the pixel units on the right of the data lines firstly can be respectively adjusted on the pixel units of each row.

A driving method for an LCD device will be detailed in the following. This driving method is implemented through utilizing the LCD device 200 of the above-mentioned embodiment. Referring to FIG. 2 again, the LCD device 200 includes a plurality of pixel units 110 which are arranged in an array of rows, a plurality of data lines 220, a plurality of first scan lines 230 and a plurality of second scan lines 240. The pixel units 110 of each row are divided into a plurality of first pixel units 1101 and a plurality of second pixel units 1102. Each of the data lines 220 is electrically coupled to the first pixel unit 1101 and the second pixel unit 1102 of each row, and the first pixel units 1101 and the second pixel units 1102 are respectively electrically coupled to the first scan lines 230 and the second scan lines 240. The descriptions of the same elements have been explained as above mention, so we need not go into detail herein.

Figure 4:
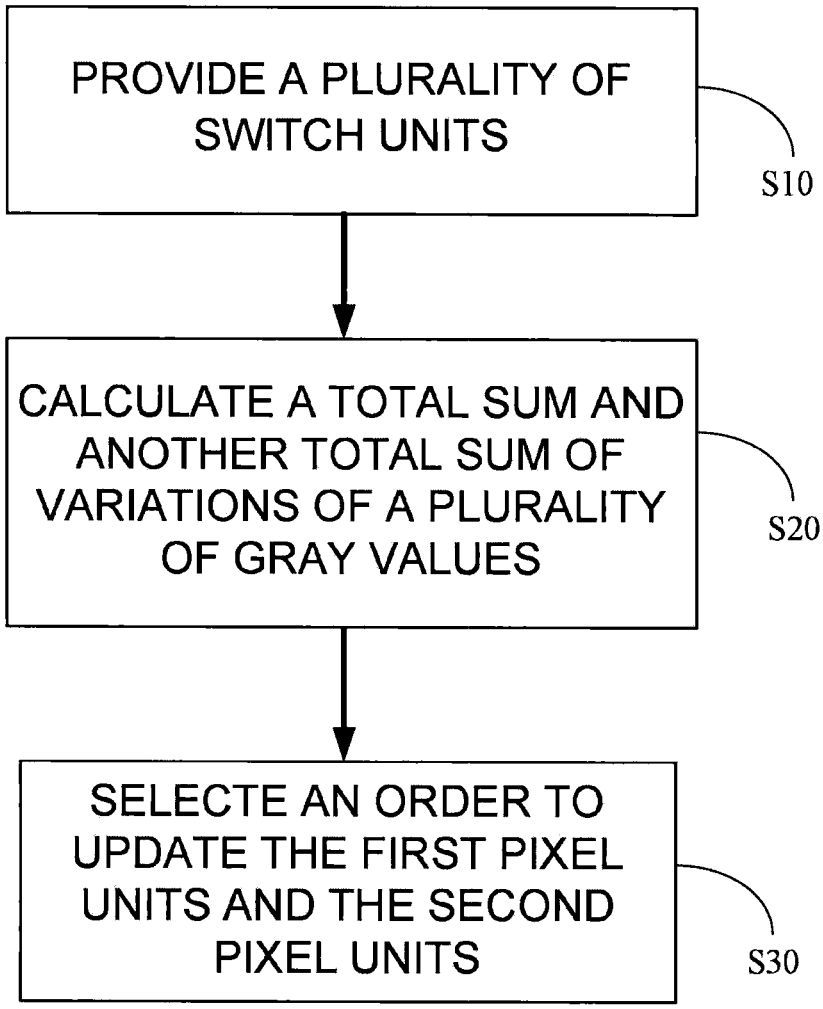
FIG. 4 is a flow chart illustrating the driving method according to the preferred embodiment of the present invention.

Referring to FIG. 4, FIG. 4 is a flow chart illustrating the driving method according to the preferred embodiment of the present invention. The method begins with step S10.

At step S10, a plurality of switch units 260 are provided, which are respectively electrically coupled to one end of each of the first scan lines 230 and one end of each of the second scan lines 240 (as shown in FIG. 3). The switch units 260 are utilized to control the conduction states of the first scan lines 230 and the second scan lines 240.

Similarly, the LCD device 200 further includes a first switching signal line 270 and a second switching signal line 280. The first switching signal line 270, which is electrically coupled to each of the first scan lines 230 via the switch units 260 for simultaneously connecting or disconnecting the first scan lines 230. Similarly, the second switching signal line 280, which is electrically coupled to each of the second scan lines 240 via the switch units 260 for simultaneously connecting or disconnecting the second scan lines 240.

Specifically, the switch units 260 are a plurality of thin film transistors preferably, and the thin film transistors, which are electrically coupled to the first switching signal line 270, are electrically coupled to each other via a plurality of gate terminals (not shown) of the thin film transistors. Similarly, the thin film transistors, which are electrically coupled to the second switching signal line 280, are electrically coupled to each other via a plurality of gate terminals (not shown) of the thin film transistors.

Figure 5:
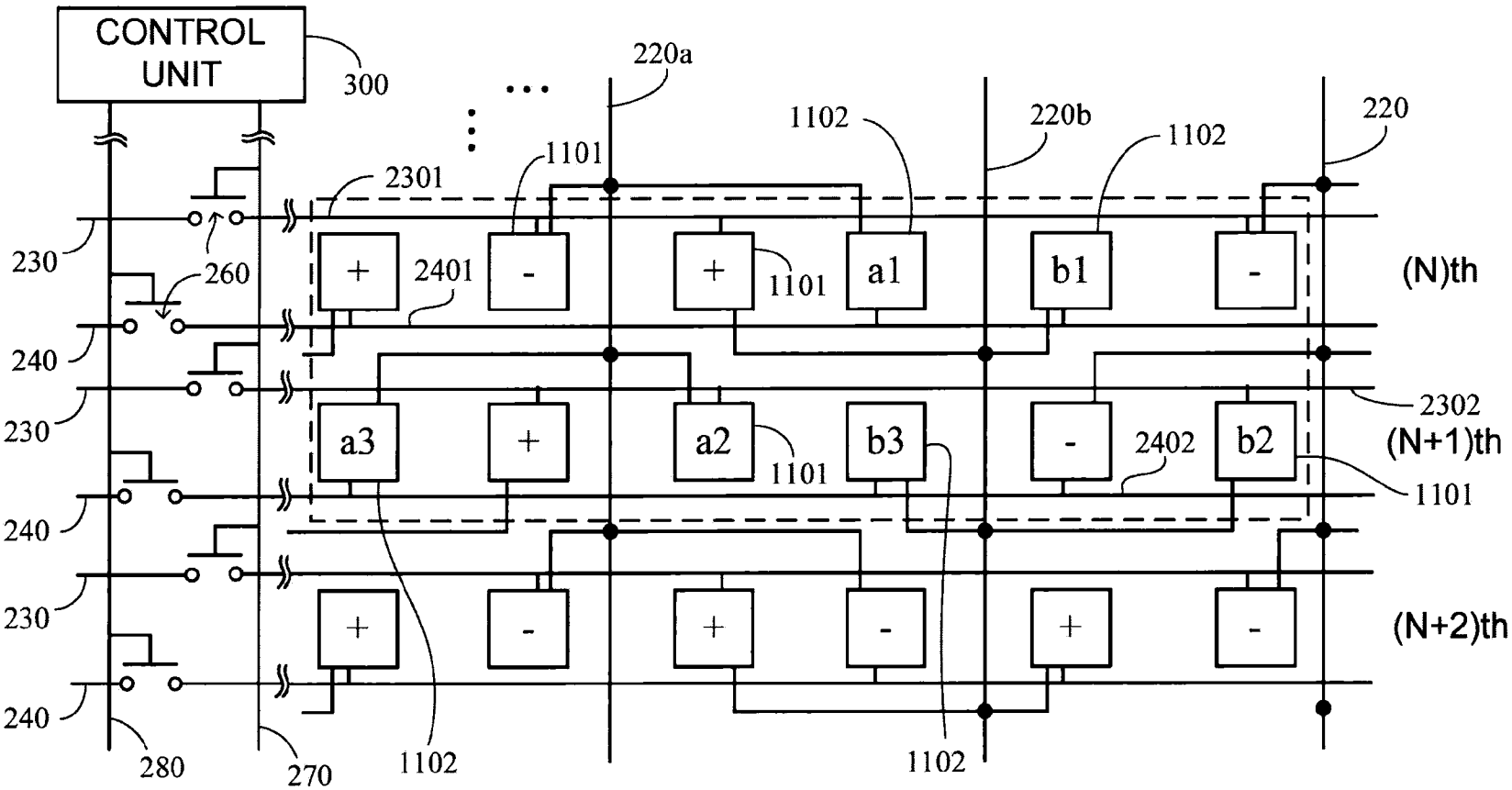
FIG. 5 is a schematic drawing illustrating the gray values of the pixel units in FIG. 2.

At step S20, a total sum of differences between a plurality of gray values which corresponds to the data lines 220 updating the first pixel units 1101 firstly is calculated, and another total sum of differences between a plurality of gray values which corresponds to the data lines 220 updating the second pixel units 1102 firstly. Specifically, referring to FIG. 5, FIG. 5 is a schematic drawing illustrating the gray values of the pixel units in FIG. 2. Before updating pixel units 110 of the (N+1)th row, we assume the order that data lines 220*a* and 220*b* transmit the image signals can be determined only according to the pixel units 110 within a dashed box (similarly, it can be extended to the entire panel). It should be noted that each pixel unit 110 has their respective image signals, and each image signal has a gray value, which is an integer between 0 and 255. We suppose that the pixel units 110, which are updated last by the data line 220*a* and 220*b*, are the second pixel units 1102 with the gray value a1 and b1.

The step herein of calculating the differences between the gray values, which corresponds to the data lines 220 updating the first pixel units 1101 firstly, is to calculate the differences between the gray values which corresponds to the data lines 220*a* and 220*b*, that is, the data lines 220*a* and 220*b* update the first pixel units 1101 with the gray value a2 and b2 firstly on the pixel unit 110 of the (N+1)th row. The total sum Q1 of the differences between the gray values is mathematically expressed as Q1=|a1−a2|+|b1−b2|. Similarly, the step herein of calculating the differences between the gray values, which corresponds to the data lines 220 updating the second pixel units 1102 firstly, is to calculate the differences between the gray values which corresponds to the data lines 220*a* and 220*b*, that is, the data lines 220*a* and 220*b* update the second pixel units 1102 with the gray value a3 and b3 firstly on the pixel unit 110 of the (N+1)th row. The another total sum Q2 of the differences between the gray values is mathematically expressed as Q2=|a1−a3|+|b1−b3|.

At step S30, an order to update the first pixel units and the second pixel units on the pixel units of each row is selected according to comparing the total sum Q1 with the another total sum Q2. The order which to update the first pixel units 1101 or the second pixel units 1102 firstly is according to whichever total sum of the differences between the gray values thereof is smaller.

For example, the control unit 300 is utilized to execute the steps S20 and S30. The control unit 300 is electrically coupled to one end of the first switching signal line 270 and one end of the second switching signal line 280. The control unit 300 outputs a first control signal 20 to the first switching signal line 270 and outputs a second control signal 40 to the second switching signal line 280. The first control signal 20 and the second control signal 40 are utilized to control a conduction order of the corresponding switch units 260 so as to update the first pixel units 1101 firstly or to update the second pixel units 1102 firstly on the pixel units 110 of each row.

When the total sum Q1 of the differences between the gray values for updating the first pixel units 1101 firstly is larger the another total sum of the differences between the gray values for updating the second pixel units 1102 firstly, the switch units 260 (correspond to the second switching signal line 280) switch on firstly. Then the second scan lines 240 is applied a high-voltage signal for updating the second pixel units 1102 firstly and then to conduct the first scan lines 230 for updating the first pixel units 1101 secondly. In short, when Q1>Q2, the second scan lines 2402 conduct firstly and the first scan lines 2302 conduct secondly through controlling the first control signal 20 and the second control signal 40.

Similarly, when the another total sum Q2 of the differences between the gray values for updating the second pixel units 1102 firstly is larger the total sum Q1 of the differences between the gray values for updating the first pixel units 1101 firstly, the switch units 260 (correspond to the first switching signal line 270) switch on firstly. Then the first scan lines 230 are applied a high-voltage signal for updating the first pixel units 1101 firstly and then to conduct the second scan lines 240 for updating the second pixel units 1102 secondly. In short, when Q1<Q2, the first scan lines 2302 conduct firstly and the second scan lines 2402 conduct secondly through controlling the control signal 20 and the first control signal 40.

In summary, the driving paths of the smaller differences between the gray values can be analyzed according to different frames (i.e., the image signals) to adjust the order of updating the scan lines in accordance with driving method for the LCD device of the present invention. It can be seen from this that the driving paths of the smaller differences between the gray values cause that the voltage differences between transitions of the data lines are smaller. Therefore, the power consumption of the data chips is decreased.

While the preferred embodiments of the present invention have been illustrated and described in detail, various modifications and alterations can be made by persons skilled in this art. The embodiment of the present invention is therefore described in an illustrative but not restrictive sense. It is intended that the present invention should not be limited to the particular forms as illustrated, and that all modifications and alterations which maintain the spirit and realm of the present invention are within the scope as defined in the appended claims.

What is claimed is:

1. A liquid-crystal display device capable of changing a scan order, comprising:

a plurality of pixel units which are arranged in an array of rows, the pixel units of each row being divided into a plurality of first pixel units and a plurality of second pixel units;

a plurality of data lines, each of the data lines being electrically coupled to the first pixel unit and the second pixel unit of each row for transmitting image signals;

a plurality of first scan lines and a plurality of second scan lines, the first scan lines and the second scan lines being disposed parallel to each other, wherein the pixel units of each row are disposed between one of the first scan lines and one of the second scan lines, the first pixel units and the second pixel units being respectively electrically coupled to the first scan line and the second scan line, characterized in that the liquid-crystal display device further comprises a plurality of switch units respectively electrically coupled to one end of each of the first scan lines and one end of each of the second scan lines for controlling conduction states of the first scan lines and the second scan lines, thereby controlling an order for updating the image signals for the first pixel units and the second pixel units, which further comprises a first switching signal line, which is electrically coupled to each of the first scan lines via the switch units for simultaneously connecting or disconnecting the first scan lines; and a second switching signal line, which is electrically coupled to each of the second scan lines via the switch units for simultaneously connecting or disconnecting the second scan lines.

2. The liquid-crystal display device according to claim 1, characterized in that the switch units are a plurality of thin film transistors.

3. The liquid-crystal display device according to claim 2, characterized in that the thin film transistors which are electrically coupled to the first switching signal line are electrically coupled to each other via a plurality of gate terminals of the thin film transistors; the thin film transistors which are electrically coupled to the second switching signal line are electrically coupled to each other via a plurality of gate terminals of the thin film transistors.

4. The liquid-crystal display device according to claim 3, characterized in that the first control signal and the second control signal are utilized to control a conduction order of the corresponding switch units so as to control updating either the first pixel units firstly or the second pixel units firstly in the pixel units of each row.

5. The liquid-crystal display device according to claim 1, characterized in that the liquid-crystal display device further comprises a control unit, the control unit being electrically coupled to one end of the first switching signal line and one end of the second switching signal line, thereby outputting a first control signal to the first switching signal line and outputting a second control signal to the second switching signal line.

6. The liquid-crystal display device according to claim 1, characterized in that polarities of the pixel units which are arranged in an array are distributed as dot inversion.

7. A driving method for a liquid-crystal display device capable of changing a scan order, the liquid-crystal display device comprising a plurality of pixel units which are arranged in an array of rows, a plurality of data lines, a plurality of first scan lines and a plurality of second scan lines, each row of the pixel units being divided into a plurality of first pixel units and a plurality of second pixel units, each of the data lines being electrically coupled to each row of the first pixel unit and the second pixel unit, the first pixel units and the second pixel units respectively electrically coupled to the first scan line and the second scan line, characterized in that the driving method comprises:

providing a plurality of switch units respectively electrically coupled to one end of each of the first scan lines and one end of each of the second scan lines for controlling conduction states of the first scan lines and the second scan lines;

calculating a first total sum of differences between a plurality of gray values which corresponds to the data lines updating the first pixel units firstly, and calculating a second total sum of differences between a plurality of gray values which corresponds to the data lines updating the second pixel units firstly; and selecting an order to update the first pixel units and the second pixel units on the pixel units of each row according to comparing the first total sum with the second total sum.

8. The driving method according to claim 7, characterized in that the order to update the first pixel units and the second pixel units on the pixel units of each row according to comparing the first total sum with the second total sum further comprises a step of:

when the first total sum which corresponds to the data lines updating the first pixel units firstly is larger than the second total sum which corresponds to the data lines updating the second pixel units firstly, switching on the second scan line and then on the first scan line for firstly conducting the second scan line and then conducting the first scan line for updating the second pixel units firstly and then updating the first pixel units secondly.

9. The driving method according to claim 7, characterized in that the order to update the first pixel units and the second pixel units on the pixel units of each row according to comparing the first total sum with the second total sum further comprises a step of:

when the second total sum which corresponds to the data lines updating the second pixel units firstly is larger than the first total sum which correspond to the data lines updating the first pixel units firstly, switching on the first scan line and then on the second scan line for firstly conducting the first scan line and then conducting the second scan line for updating the first pixel units firstly and then updating the second pixel units secondly.

10. A liquid-crystal display device capable of changing a scan order, comprising:

a plurality of pixel units which are arranged in an array of rows, the pixel units of each row being divided into a plurality of first pixel units and a plurality of second pixel units;

a plurality of data lines, each of the data lines being electrically coupled to the first pixel unit and the second pixel unit of each row for transmitting image signals;

a plurality of first scan lines and a plurality of second scan lines, the first scan lines and the second scan lines being disposed parallel to each other, wherein the pixel units of each row are disposed between one of the first scan lines and one of the second scan lines, the first pixel units and the second pixel units being respectively electrically coupled to the first scan line and the second scan line; and a plurality of switch units respectively electrically coupled to one end of each of the first scan lines and one end of each of the second scan lines for controlling conduction states of the first scan lines and the second scan lines, thereby controlling an order of updating the image signals for the first pixel units and the second pixel units, wherein the order which to firstly update the first pixel units or the second pixel units is according to whichever total sum of differences between gray values thereof is smaller.

11. The liquid-crystal display device according to claim 10, characterized in that the liquid-crystal display device further comprises:

a first switching signal line, electrically coupled to each of the first scan lines via the switch units for simultaneously connecting or disconnecting the first scan lines; and a second switching signal line, electrically coupled to each of the second scan lines via the switch units for simultaneously connecting or disconnecting the second scan lines.

12. The liquid-crystal display device according to claim 11, characterized in that the liquid-crystal display device further comprises a control unit, the control unit being electrically coupled to one end of the first switching signal line and one end of the second switching signal line, thereby outputting a first control signal to the first switching signal line and outputting a second control signal to the second switching signal line.

13. The liquid-crystal display device according to claim 12, characterized in that the first control signal and the second control signal are utilized to control a conduction order of the corresponding switch units so as to control updating either the first pixel units firstly or the second pixel units firstly on the pixel units of each row.

14. The liquid-crystal display device according to claim 10, characterized in that the switch units are a plurality of thin film transistors.

15. The liquid-crystal display device according to claim 14, characterized in that the thin film transistors electrically coupled to the first switching signal line, are electrically coupled to each other via a plurality of gate terminals of the thin film transistors, and the thin film transistors electrically coupled to the second switching signal line, are electrically coupled to each other via a plurality of gate terminals of the thin film transistors.

* * * * *